US006039282A

United States Patent [19]

Hermanns et al.

[11] Patent Number: 6,039,282

[45] Date of Patent: Mar. 21, 2000

[54] METHOD FOR MONITORING THE APPLICATION OF PARAFFIN ON A TRAVELING YARN

[75] Inventors: Ferdinand-Josef Hermanns, Erkelenz, Germany; Urs Meyer, Zurich, Switzerland

[73] Assignee: W. Schlafhorst AG & Co., Moenchengladbach, Germany

[21] Appl. No.: 09/217,007

[22] Filed: Dec. 21, 1998

[30] Foreign Application Priority Data

Dec. 20, 1997 [DE] Germany ..... 197 57 009

[51] Int. Cl.[7] ..... B65H 63/00; B05C 11/00

[52] U.S. Cl. ..... 242/485.1; 28/219; 118/78; 118/688; 242/477.8; 242/486.3

[58] Field of Search ..... 242/470, 477.8, 242/485, 485.1, 486.3; 28/217, 219; 118/78, 688

[56] References Cited

U.S. PATENT DOCUMENTS

| | | | |
|---|---|---|---|
| 4,696,435 | 9/1987 | Hermanns | 242/477.8 |
| 4,805,844 | 2/1989 | Hermanns et al. . | |
| 5,301,887 | 4/1994 | Wirtz et al. . | |
| 5,826,815 | 10/1998 | Hermanns et al. | 242/477.8 |
| 5,954,289 | 9/1999 | Hermanns et al. | 242/477.8 |

FOREIGN PATENT DOCUMENTS

| | | |
|---|---|---|
| 33 40 459 A1 | 5/1984 | Germany . |
| 40 01 793 C1 | 3/1991 | Germany . |
| 40 10 469 A1 | 10/1991 | Germany . |
| 40 30 892 A1 | 4/1992 | Germany . |
| 42 26 265 A1 | 2/1994 | Germany . |
| 37 03 869 C2 | 12/1996 | Germany . |
| 195 47 870 A1 | 6/1997 | Germany . |
| 196 33 256 C1 | 10/1997 | Germany . |

*Primary Examiner*—Michael R. Mansen
*Attorney, Agent, or Firm*—Kennedy Covington Lobdell & Hickman LLP

[57] ABSTRACT

In order to improve the traveling and sliding properties of a yarn during its further processing, in particular for knitting, it is waxed during rewinding in cheese winding machines by passing it along a paraffin body. When the paraffin body is used up, the unwaxed yarn can cause yarn breaks or even needle breakages, which leads to production errors or lost production. At the winding stations, the drive of the friction drum is switched on and off at intervals to cause alternating acceleration phases with slippage between the friction drum and the bobbin and intervening slippage- free run-out phases to prevent pattern windings. The slippage is monitored over the course of the winding operation. If the slippage decreases in successive acceleration phases and remains at a low level, while the drive output of the friction drum remains unchanged, this is interpreted to indicate an outage of the paraffin application.

9 Claims, 6 Drawing Sheets

METHOD FOR MONITORING THE APPLICATION OF PARAFFIN ON A TRAVELING YARN

FIELD OF THE INVENTION

The present invention relates to a method for monitoring the application of paraffin to a traveling yarn at a winding station of a cheese-producing textile machine.

BACKGROUND OF THE INVENTION

It is known to sometimes be necessary to reduce the coefficient of friction of a yarn in connection with processing it. A known method for doing this is the application of a paraffin wax. The traveling and sliding properties, in particular for machine-knitting and knitting, are considerably improved by the paraffin particles applied to the yarn. The application of paraffin takes place, for example, on bobbin winding machines during the rewinding of the yarn from cops to cheeses. In the process, the yarn is brought into contact with a paraffin body, which is used up by removal of the paraffin.

When a paraffin body is used up, or its contact with the yarn is interrupted, but not detected, the unwaxed yarn can cause yarn breaks during subsequent processing, or even needle breakage of a knitting machine, which leads to production errors or lost production. Therefore various methods and devices have already been proposed, which make possible monitoring of the paraffin application to the yarn.

Most methods are based on monitoring the paraffin body itself and signaling when it is detected that it has been exhausted. It is disadvantageous here that the contact of the paraffin body with the yarn can also be disrupted if the paraffin body is not exhausted, but is only jammed or dirty.

A method and a device are described in German Patent Publication DE 195 47 870 A1, by means of which the result of waxing can be checked. To this end, heat sensors are arranged in the path of the traveling yarn before and after the paraffin application device, which are charged with sliding friction by the traveling yarn. An increase in friction exceeding a defined value is interpreted as a defect in the paraffin application device, which results in switching of the respective bobbin.

Additional sensors are required for the known method and the known device, whose employment as a rule is not anticipated in a bobbin winding machine. It is therefore necessary to adapt the signal processing to these sensors.

SUMMARY OF THE INVENTION

It is accordingly an object of the present invention to perform the monitoring of paraffin application to a traveling yarn by means which are already employed for monitoring the ongoing winding operation.

This object is attained by a method for monitoring the application of paraffin to a traveling yarn at a winding station of a cheese-producing textile machine, wherein a cheese is driven frictionally by peripheral contact with a driven friction drum, and the driving of the friction drum is alternatingly switched on and off at intervals to produce periodic acceleration phases causing slippage between the friction drum and the cheese and intervening slippage-free run-out phases for preventing pattern yarn windings. According to the present invention, the frictional behavior between the cheese and the friction drum during the yarn winding operation is monitored by determining and evaluating values which are proportional to the coefficient of friction. In particular, the peripheral speeds of the friction drum and the cheese as winding of the cheese progresses are continuously determined and compared and significant deviations in the relationship of the peripheral speeds of the friction drum and the cheese are identified as a loss of paraffin application.

If the friction drum and the bobbin run at the same angular speed, or if the angular speeds have a definite ratio, for example 1:1.5, which causes strong patterns, the layers of yarn are placed on top of each other. Because of this the reversing points are also located on top of each other. This leads to the unwanted formation of bulges on the surface of the bobbin, i.e., so-called pattern windings. The build-up of pattern windings can be effectively reduced by a changing slippage between the friction drum and the bobbin. Changing slippage can be generated by acceleration in intervals of the friction drum. With an unchanged drive output, the slippage changes with the increase in the bobbin diameter and therefore increasing mass of the bobbin. In accordance with the invention it is only assumed that the paraffin application has failed when the yarn deposit shift on the surface of the cheese noticeably changes during successive acceleration phases of the cheese.

The drive of the bobbin takes place by friction by means of the friction drum. When the friction drum is accelerated, based on the slippage, the circumferential speed of the bobbin lags more or less behind the circumferential speed of the friction drum. Pattern disruption is effected by means of this slippage. The frictional force, and therefore the drive moments, on the bobbin are functions of bobbin-technological parameters, such as contact pressure compensation, type of yarn, mass of the bobbin, yarn preparation, etc.

Sensors are applied to the friction drum as well as to the holder of the cheese in the winding frame, by means of which the angle of rotation, and therefore the angular speed, or the length of the rotation period, of the two rotating bodies is continuously determined. Customarily, this sensing is used for detecting the diameter of the cheese, which continuously changes as bobbin winding progresses. Within the scope of the present invention, these sensors are also employed for monitoring the paraffin application. Here, the invention is based on the knowledge that if the paraffin application fails, the yarn, which increasingly covers the surface of the cheese because of the traversing lift, significantly changes the frictional behavior of the cheese surface after only a short time.

If the paraffin application stops as bobbin winding progresses, the change in the frictional behavior of the bobbin surface can be easily detected. But since the frictional behavior of the bobbin surface formed by a waxed yarn is normally known as a function of the winding station, the batch and the winding parameters, at the latest after the batch has been running for a period of time, it is also possible after a cheese change to detect that the frictional behavior of the cheese surface is outside of expected values.

To prevent an extended unwaxed length of yarn from collecting on the cheese, it is provided in accordance with the invention to immediately stop the winding station after the loss of paraffin application has been detected. But it would also be possible, however with incurring losses, to finish the winding of the cheese and to subsequently remove it as a sub-standard bobbin.

It is useful to emit a signal by which an operator is called when the winding station is stopped. The operator can then initiate appropriate steps for restoring the correct application of paraffin.

Depending on the subsequent processing intended for the yarn wound on the cheese, it may be necessary to avoid even short yarn sections lacking paraffin. In such cases, it is possible, after stopping the winding station, to reversely rotate the cheese and to withdraw the unwaxed yarn section from the cheese by means of the suction nozzle normally present at the winding station, or even by hand.

The absolute magnitude of the slippage between the friction drum and the bobbin occurring during the acceleration phases during pattern disruption is a very essential measurement for determining the frictional behavior of the cheese on the friction drum. This magnitude can be determined by the evaluation of the angular velocities, or the lengths of the rotation periods, of the friction drum and the cheese. However, to determine this slippage, the bobbin diameter, which continuously changes in the course of the cheese travel, must be calculated in a known manner and in the way already explained above. This calculation cannot be performed during the acceleration phases, since during this time a false diameter would be determined because of the slippage. For this reason, the diameter of the bobbin is calculated in the acceleration-free run-out phases, and the course of increase of the bobbin diameter for the acceleration phase is precalculated based on the previous values. The magnitude of the slippage in the slippage phases can be quantitatively determined from the difference between the bobbin diameter distorted by the slippage and the actual value of the bobbin diameter.

If the slippage then decreases in sequential acceleration phases, while the drive output remains unchanged, and remains on a low level, this decrease in slippage is treated in accordance with the invention as a signal that no paraffin was applied to the yarn. The coefficient of friction, and therefore the frictional force, have increased. This increase can be noted so clearly that its association with the paraffin application is easily possible.

If the detected frictional force, which is transmitted by means of the drive moment from the friction drum to the bobbin, is also included in the evaluation, conclusions regarding the frictional behavior of the surface of the cheeses can be made even more distinctly. If the deceleration of the two rotating bodies within the scope of the pattern interruption is additionally determined during their slippage-free run-out phases, losses due to friction, inertia and convection, as well as load moments (such as may be caused for example by the tensile force of the yarn being wound) can be determined. But these losses are also present in the acceleration phases. In this manner, it is possible to determine parameters which have no connection at all with the frictional behavior of the surface of the cheese on the friction drum. By this means, the lack of paraffin application becomes noticeable even faster and clearer. Most of all, it is possible by this means to clearly differentiate the effect on the frictional force as a function of the slippage based upon the application of paraffin or the lack thereof at the start of the bobbin winding operation.

If a sensor for the tensile force of the yarn is provided at the winding station, its yield values, which constitute the load moment of the two rotating bodies, can alternatively be included in the evaluation. By this means, it is at least prevented that fluctuations of the tensile yarn force distort the result of the slip determination.

Not only is the absolute slippage magnitude included in the evaluation by determining the deposit shift, the result of the slippage, particularly the slippage course and the length of the slippage, is also determined. The inclusion of this additional dimension also leads to more significant deviations, in this case in the function of the deposit shift as a function of the slippage, in contrast to an isolated consideration of the slippage.

An improvement of the ability to draw conclusions regarding paraffin application can also be achieved if a reference value is determined by averaging the frictional behavior of the cheeses at several winding stations, from which a certain measurement of a deviation may be defined as indicating the lack of paraffin application.

The invention will be explained in greater detail hereinbelow by means of exemplary embodiments with reference to the accompanying drawings.

DETAILED DESCRIPTION OF THE PREFERRED EMBODIMENTS

Figure 1:
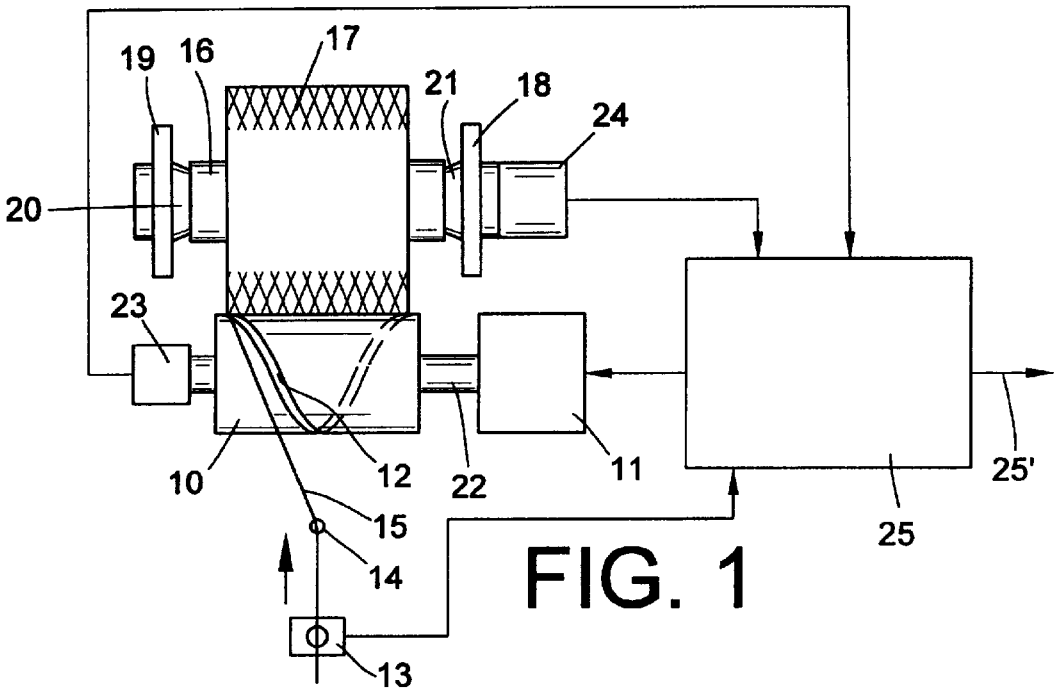
FIG. 1 is a schematic depiction of a winding arrangement with an evaluation device for determining slippage.

Referring now to the accompanying drawings and initially to FIG. 1, a winding device of a winding station of a bobbin winding machine is shown only schematically in FIG. 1. The winding device basically has a friction drum 10 driven by means of a drive motor 11 in peripheral surface contact with a bobbin tube 16 for winding a yarn 15 thereon as a cross wound bobbin commonly referred to as a so-called cheese 17. The bobbin tube 16 is held by means of two bobbin plates 18, 19, which frictionally engage and grip the open ends of the tube 16 by means of respective cones 20, 21 to rotate integrally with the tube 16 and therefore with the bobbin 17. The bobbin plates 18, 19, are seated in a bobbin frame, not represented, which is pivotable around an axis which is parallel with the shaft 22 of the friction drum 10. The friction drum 10 is provided with a reverse thread groove 12, so that it is simultaneously used as a traversing device for cross winding the yarn 15. The yarn 15 travels in the direction of the arrows over a sensor 13 for monitoring the tensile force of the yarn and then through a yarn eye 14 onto the drum 10.

Figure 2:
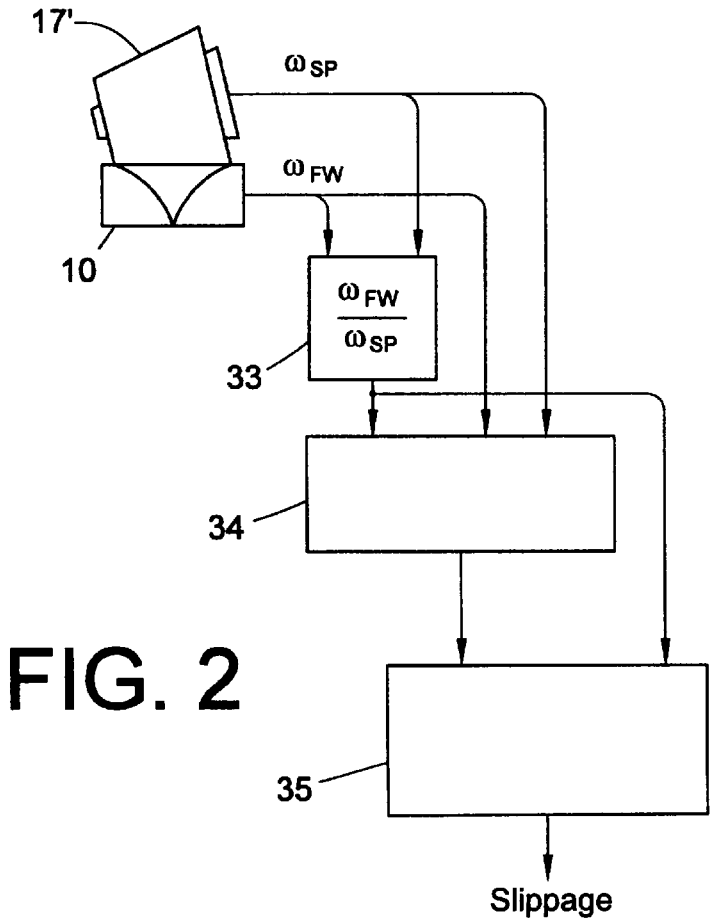
FIG. 2 represents the structure of the evaluation device in a block circuit diagram.

Since the invention is applicable both to the production of cylindrical cheeses as well as to the production of conical cheeses, a cylindrical cheese 17 is represented in FIG. 1, and a conical cheese 17' is represented in FIG. 2. The following description is intended to be applicable to both such winding applications and, hence, references hereinafter to a bobbin radius or bobbin diameter indicate, in connection with a conical cheese 17', the neutral diameter or the so-called driving diameter.

A sensor 23 which, for example, is designed as an angle encoder, is associated with the shaft 22 of the friction drum 10. The angular (i.e., peripheral) speed, the period length (i.e., the time required for a single revolution of the drum) or the rpm of the friction drum 10 are detected by means of this sensor 23. A sensor 24, which is also designed as an angle encoder, is associated with the bobbin plate 18 for detecting the same measured values of the bobbin 17. The signals of the sensors 23 and 24 are transmitted to and processed in a control and evaluation device 25.

To prevent pattern windings in the course of the production of the bobbin 17, a so-called pattern disruption methodology is performed, during which slippage between the friction drum 10 and the bobbin 17 is intermittently generated. This is achieved by alternatingly switching the drive motor 11 of the friction drum 10 on and off. Specifically, when the rpm of the friction drum 10 falls below a predetermined value after the drive motor 11 has been shut off, the drive motor 11 is switched on again to accelerate the friction drum 10 up to maximum rpm after which the drive motor 11 is switched off again, after which the process is repeated. Because of the mass inertia of the bobbin, a slippage between the friction drum 10 and the cylindrical bobbin 11 is created during the acceleration of the friction drum 10.

Starting from the bobbin tube 16, which initially is seated empty against the friction drum 10, the radius or diameter of the bobbin increases progressively as the yarn 15 is wound thereon, until the bobbin 17 has reached its maximum radius or diameter. The bobbin radius $r_{sp}$ can be calculated at any point in time, based on the signals of the sensors 23, 24, in accordance with the following equation:

$$\omega_{sp}\times r_{sp}=\omega_{fw}\times r_{fw}, \text{ and from this } r_{sp}=(\omega_{fw}\times r_{fw})/\omega_{sp}.$$

wherein the symbols represent the following values:

$\omega_{sp}$ is the angular speed of the bobbin, $\omega_{fw}$ is the angular speed of the friction drum, $r_{sp}$ is the radius of the bobbin, and $r_{fw}$ is the radius of the friction drum.

Figure 3:
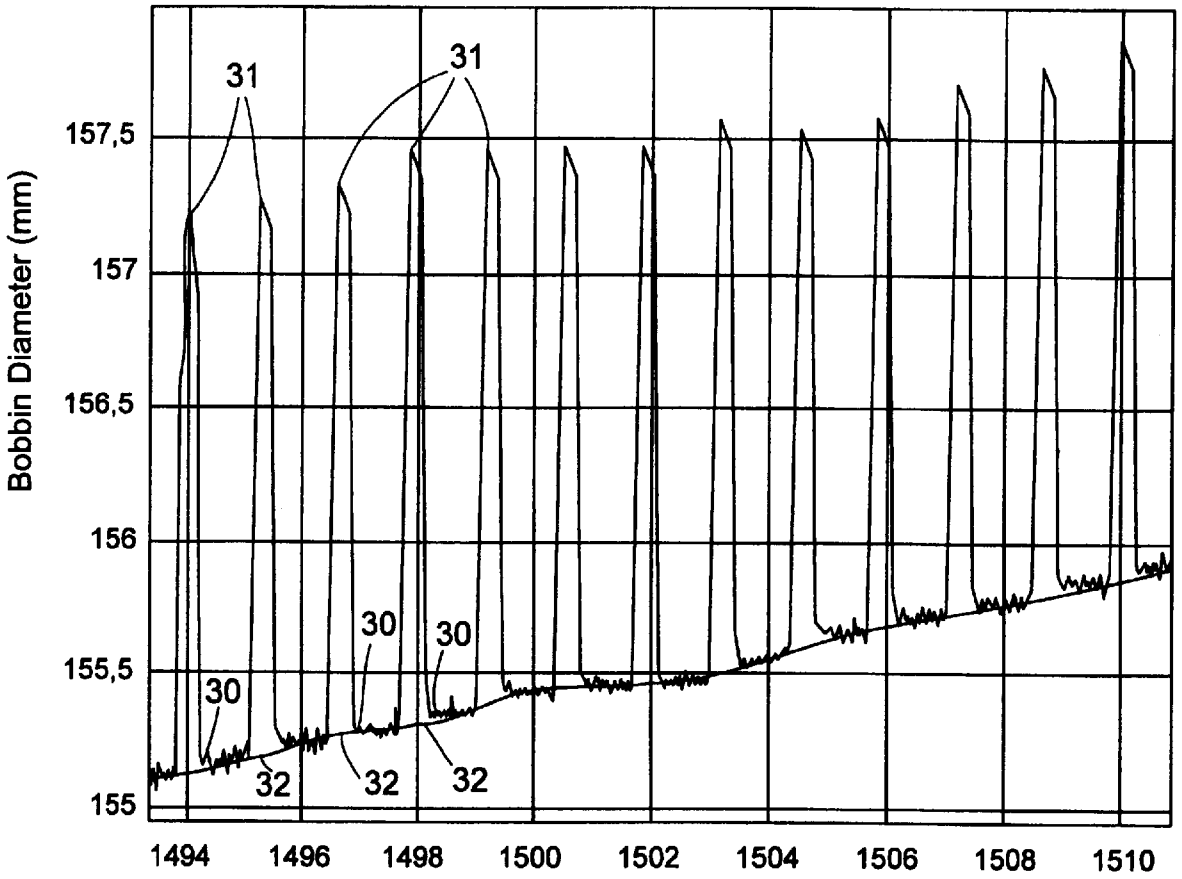
FIG. 3 is a graph representing a small portion of a bobbin winding operation in accordance with the present invention.

If this calculation is continuously performed at short time intervals, for example at time intervals of 0.1 seconds, a curve can be plotted such as is represented in FIG. 3 as a diameter dimension ($2\times r_{sp}$) plotted against the elapsed time of the winding process.

FIG. 3 shows a diameter increase of approximately 0.75 mm resulting from the progression of a bobbin diameter from approximately 155.15 to approximately 155.9 mm during an elapsed time of approximately 17 seconds. The lower sections 30 of this curve correspond to the run-out phases in which the drive motor 11 of the friction drum 10 is switched off, so that in case of a cylindrical bobbin geometry the friction drum 10 and the bobbin 17 run free of slippage. Therefore the above-mentioned equation can be applied in these run-out phases 30, so that the course of the curve represented in the run-out phases 30 corresponds to the actual course of the increase of the bobbin radius $r_{sp}$, or here of the diameter. In the acceleration phases 31 located between the run-out phases 30, the bobbin 17 has a lower circumferential speed than the friction drum 10. There, the calculation of the bobbin radius $r_{sp}$ or of the bobbin diameter produces, by means of the mentioned equation, an inaccurate bobbin diameter or bobbin radius, which is distorted by the occurring slippage. Because of the slippage, a non-existent increase in the bobbin radius or bobbin diameter is calculated by means of the above equation, which is larger than the actual course of increase of the bobbin diameter in the acceleration phase 31. The equation: $v_{sp}=(1-S)\times v_{tr}$ applies to the bobbin speed, wherein S represents the slippage and the other values have the above-defined meanings.

The drum speed $v_{tr}$ and the bobbin radius $r_{sp}$ can thus be processed as known values in the winding process. Therefore, the following equations are also applicable:

$$\omega_{sp}\times r_{sp}=(1-S)\times v_{tr},$$

or $$S=1-(\omega_{sp}\times r_{sp})/v_{tr},$$

and therefore $$S=[v_{tr}-(\omega_{sp}\times r_{sp})]/v_{tr}.$$

With $v_{tr}=\omega_{sp}\,|_{S=0}\times r_{sp}$, the following applies:

$$S=[(\omega_{sp}|_{S=0}\times r_{sp})-(\omega_{sp}\times r_{sp})]/(\omega_{sp}|_{S=0}\times r_{sp}).$$

From this follows: $S=1-(\omega_{sp}/\omega_{sp}|_{S=0})$

In the acceleration phases, the bobbin radius is calculated as a so-called distorted bobbin radius:

$$r_{sp}|_{r\ verf.}=r_{sp}\times(\omega_{sp}|_{s=0}/\omega_{sp}).$$

In all the foregoing equations $\omega_{sp}|_{s=0}$ means: on the condition that the slippage=0.

Therefore, the following relationship results for the slippage between the drum and the bobbin:

$$S=(r_{sp}|_{r\ verf.}-r_{sp})/r_{sp}|_{r\ verf.}$$

Figure 4:
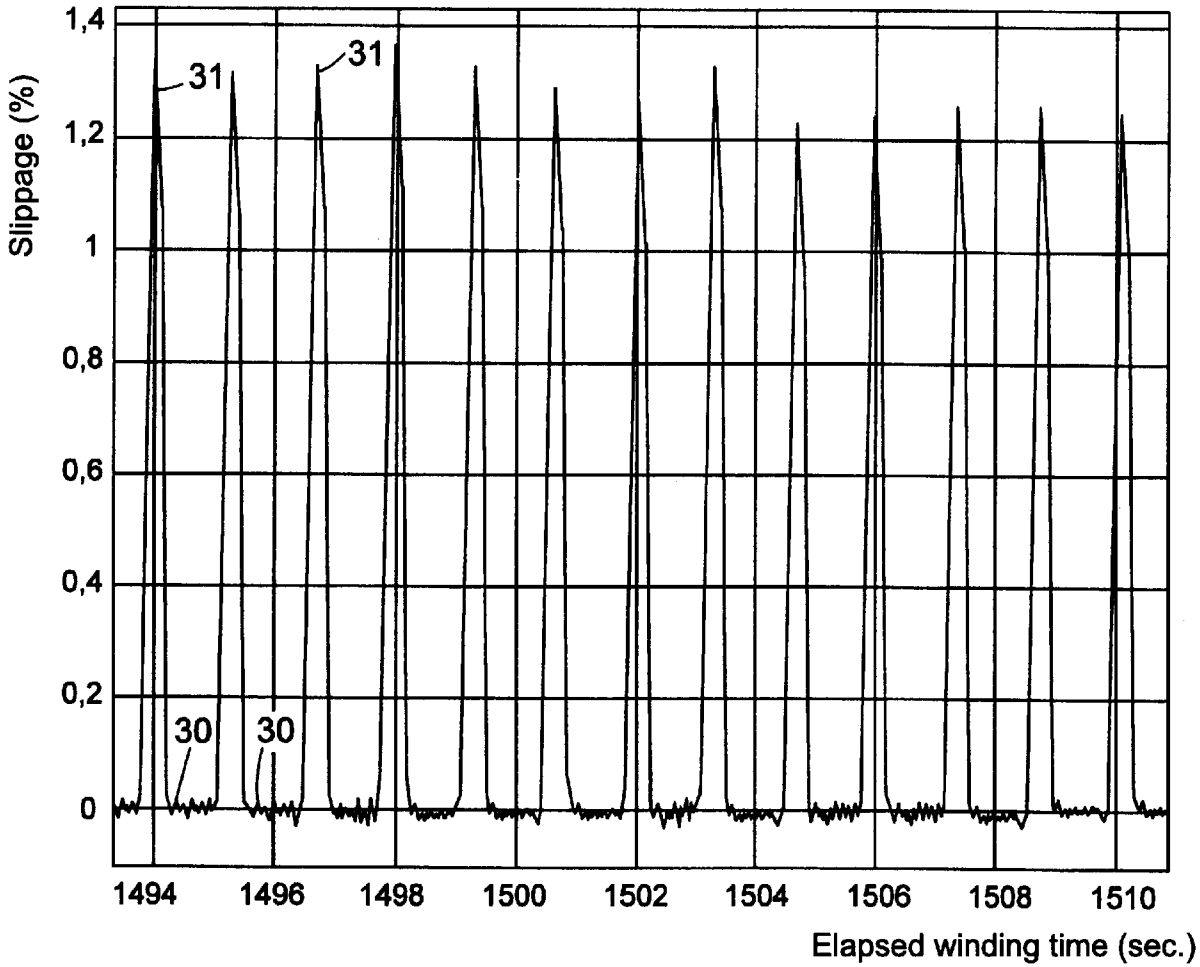
FIG. 4 is another graph representing the slippage occurring between a friction drum and a bobbin during the portion of bobbin winding operation shown in FIG. 3, wherein the slippage is scaled to the diameter of the bobbin.

Taking into account the historical actual progression in the increase of the bobbin radius or the bobbin diameter calculated from the measured values in one or several preceding run-out phases 30, the expected future actual progression in the increase of the bobbin radius or the bobbin diameter can be precalculated for the subsequent acceleration phase and represented in the form of a time-varied compensatory straight line 32 as shown in FIG. 3. The difference between the distorted bobbin radius or diameter calculated from the signals of the sensors 23, 24 in the acceleration phases 31, and the precalculated course of the increase of the bobbin diameter in accordance with the compensatory straight line 32 in the acceleration phases 31 is a measurement of the slippage which actually occurred in the acceleration phases 31. This slippage is represented in FIG. 4 as a percentage value plotted over time, scaled to the diameter of the bobbin 17.

Figure 5:
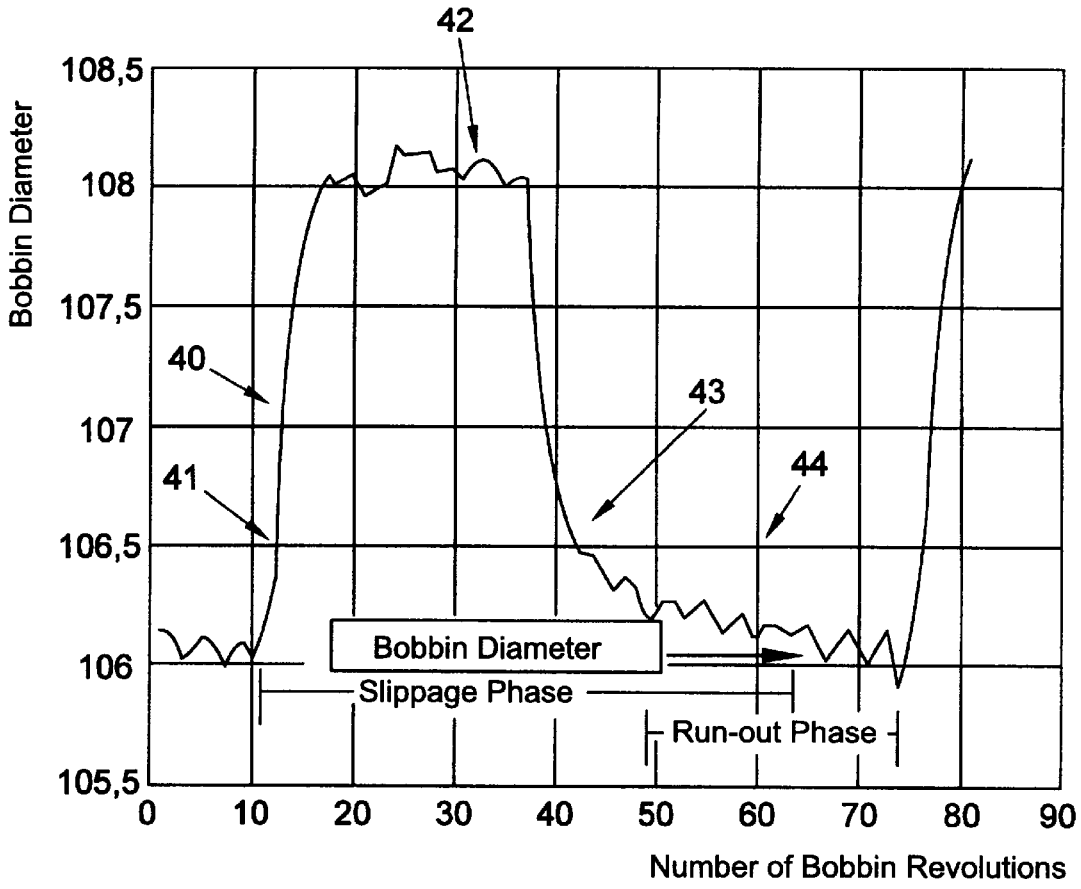
FIG. 5 is another graph showing the course of the bobbin diameter in an acceleration run- out diagram of a conical bobbin.

With conical cheeses, the driven diameter in which the circumferential speeds of the friction drum and the cheese coincide, changes fictitiously during acceleration if calculated by the above equation, as is represented in the graph of FIG. 5. Starting from the time indicated at 41, an exclusively slippage-encumbered drive takes place, whereby the bobbin diameter calculated during the acceleration phase is distorted producing a fictitious diameter increase 40, and during the time period indicated at 42 of the slippage-encumbered drive, the calculated bobbin diameter is approximately constant. After switching off the friction drum, the calculated diameter decreases immediately at the point in time indicated at 43, whereupon the calculated diameter represents a real, driven diameter wandering, proportional to the sinking rpm of the friction drum, on the bobbin from the large diameter in the direction toward the small diameter. This is the so-called run-out phase 44. Toward the end of the run-out phase 44 the driven diameter reaches a so-called neutral diameter zone based on the acceleration-free drive, in which an achieved diameter of the conical cheese can respectively be calculated.

Reaching the neutral zone depends on several influencing factors, for example on the flexing work, the conicity of the bobbin, and the friction between the drum and the bobbin, which disturbs the diameter determination. The course of the curve shows a chronological run-in or settling process. The settling process is not usable for determining the diameter of a cheese, since here the distorted diameter does not coincide with the neutral bobbin diameter. However, since it is already necessary to have an actual bobbin diameter available in a short time for the next acceleration phase, this settling process must be equalized. This takes place by utilizing data derived from the course of prior run-in periods into the neutral zone. If it is assumed that the above mentioned influencing factors do not change during a disruption cycle, it must be assumed that the previous disruption cycles have a similar course as the actual one. Based on this assumption, it is possible to prepare a model course of the actual run-in behavior. Once this model course has been found, it is possible to calculate a prediction of the neutral cone diameter at any point in time of the run-in phase.

The calculation of a compensation polynomial of the $n^{th}$ degree provides a model process. Once the model parameters (polynomial coefficients) of a predetermined number n of preceding run-in cycles have been calculated, it is possible, simultaneously with an actual concurrent run-in phase, to determine a modeled run-in phase. To this end it is necessary to average the n sets of parameters of the run-in cycles, and a simultaneous course must be produced. If the measured distorted diameter value is divided by the corresponding model diameter value, an equalized diameter course is obtained. This course is corrected by the amount of the actually valid cone diameter.

Figure 6:
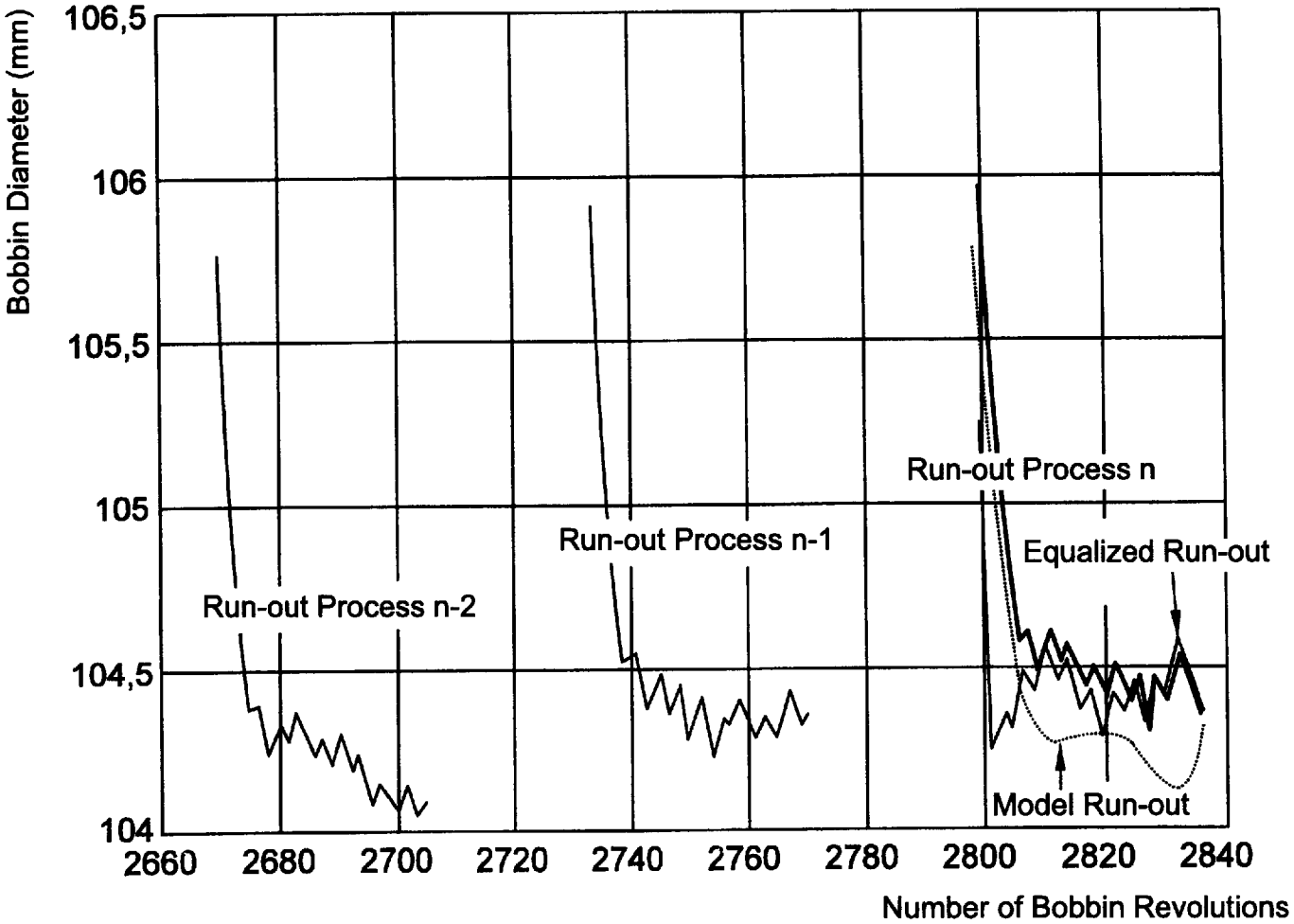
FIG. 6 is a graph representing the equalized run-out process of a conical bobbin.

The integration of several run-in cycles into the model run-out is recommended, since it must be assumed that, by means thereof, differences occurring between different run-out cycles can be averaged out. This method is represented in FIG. 6. Based on the run-outs (n−2) and (n−1), a model run-out is calculated for the subsequent actual concurrent run-out (n) and is simultaneously carried along. At the same time the determined distorted diameter course is divided by the model diameter course, which results in an equalized diameter course in the run-out phase.

The calculation of the time-variant compensatory straight line 32 and the slippage can take place, for example, in accordance with an evaluation device explained in FIG. 2. The period lengths measured by the sensors 23, 24, and therefore also the angular speed of the bobbin, $\omega_{sp}$, and of the friction drum, $\omega_{fw}$, are introduced into a quotient forming unit 33. Since the radius $r_{fw}$ of the friction drum 10 is constant, the quotient $\omega_{fw}$ to $\omega_{sp}$ is already representative of the bobbin radius $r_{sp}$, so that a multiplication by the radius $r_{fw}$ of the friction drum 10 can be omitted. However, this value cannot yet be used for a slippage determination, since it is a function of the diameter. Therefore this value is entered into a linear filter 34, for example a Kalman filter, into which the angular speed $\omega_{sp}$ of the bobbin 17' (or 17 in FIG. 1), and the angular speed $\omega_{fw}$ of the friction drum 10 are also entered. The diameter values or, in the case of the conical cheese the calculated equalized course, are only supplied to the filter in the run-out phases of the pattern disruption. This linear filter 34 constitutes the time-variant compensatory straight line 32. The calculation of the compensation radii takes place in the slippage-free phases. In the acceleration phases, the compensatory straight line is continued, based on its predetermined increase. This compensatory straight line 32 is entered, together with the signal of the quotient forming unit 33, into a subtraction device 35, which then reflects the slippage which is independent of the rpm and independent of the diameter, i.e. the slippage, which is independent of the state of the winding process.

The slippage s determined in this manner constitutes the basis which is independent of the diameter for the calculation of the deposit shift. The following equation applies for the speed of the bobbin: $v_{Spule}(t)=(1-s(t))\times v_{Trommel}(t)$.

The distance differential on the bobbin surface generated by the slippage is calculated as $$\Delta 1 = \int_{t1}^{t2} s(1) \times v_{Trommel}(t)\, dt,$$

wherein $t_2-t_1$ represents the length of time to be examined. In the case of discrete slippage and speed courses, with $\Delta t$ as the scanning time, the following applies:

$$\Delta 1 = \sum_{i=1}^{k} s(1) \times v_{Trommel}(i) \times \Delta t$$

The value $\Delta 1$ is the deposit shift. A conclusion regarding the yarn deposit on the bobbin surface can be formulated from this by using the length of a double lift on the bobbin surface as an aid. This length is drum-specific and is calculated as $1_{Trommel}=2\times gg\times 2\times\pi\times r_{Trommel}$, wherein gg is the drum pitch number (number of drum revolutions for one deposit lift on the bobbin surface). If the shift is related to a double lift, the relative shift in percent results.

$$\Delta=(\Delta 1/1_{Trommel})\times 100\%$$

and therefore:

$$\Delta = \left[\left(\sum_{i=1}^{k} s(t) \times v_{Trommel}(i) \times \Delta t\right) / (2 \times gg \times 2 \times \pi \times r_{Trommel})\right] \times 100\%$$

Since no further manipulation mechanisms are available for the shift formation, only the acceleration of the friction drum can generate the slippage required for pattern disruption and therefore the shift. Based on the fact that the drive moment is always the same in every disruption cycle independently of the motor operating point, the size of the shift during a bobbin winding operation also provides information regarding the size of the actually present slippage.

If in the course of a bobbin winding operation after every disruption cycle, i.e. the sequence of accelerations of the bobbin and its non-driven run-out, the values for the slippage and the shift are entered as dots in a diagram, tightly limited clusters of dots are created, whose position and orientation provide information regarding the quality of the respective disruption cycle, and thus of the slippage. A representation of the state of the disruption cycles results. The cloud of dots also wanders with the increasing diameter of the bobbin.

Figure 7:
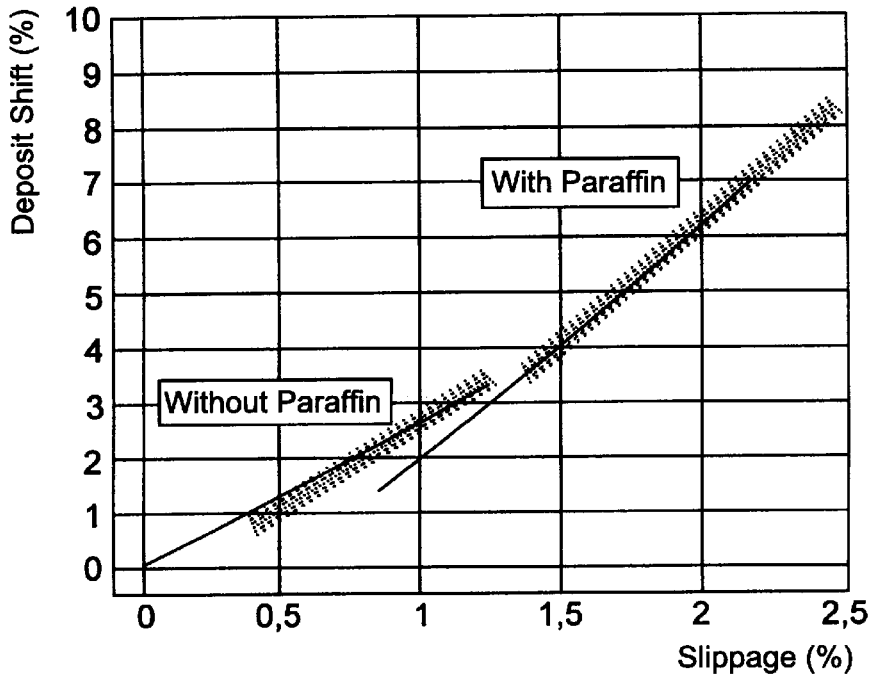
FIG. 7 is a graph showing the relative deposit shift applied over the slippage, separately for a waxed and an unwaxed yarn.

Since a waxed yarn has different frictional properties than an unwaxed yarn, the slippage occurring in the course of winding these yarns, and accordingly also the deposit shift, is different. This can be clearly seen in the slippage-deposit shift diagram represented in FIG. 7. A cluster of dots recorded during a bobbin winding operation of an unwaxed yarn clearly differs in regard to its position, extent and course from a cluster of dots which was recorded during the bobbin winding of a waxed yarn. A prerequisite for this comparison is that, besides the preparation, the setting parameters are the same during the two bobbin winding operations.

The absolute position of the cluster of dots can be compared over the entire machine or batch, i.e. between many individual units. As a result, deviations pointing to reduced or lacking paraffin application can be detected even quicker and better.

As an example, cylindrical bobbins of yarn of the same yarn count were wound at the same winding speeds. An average contact pressure compensation was set and a yarn tensile strength of 30 cN prevailed. The cluster of dots of the unwaxed yarn extends in an area of little deposit shift and slippage, approximately up to 3.5% relative deposit shift at 1.5% of slippage, while the cluster of dots of the waxed yarn, clearly distinguished from the previous cluster, extends from approximately 4% of relative deposit shift and 1.5% slippage up to 8% of relative deposit shift and over 2.5% of slippage. A slippage-shift diagram makes it possible to clearly distinguish the waxed and unwaxed state of a yarn by the position of the slippage-shift points alone.

Slippage and frictional force also have a proportional connection. Therefore, a decrease of the slippage can be detected over the course of the frictional force. The frictional force can be calculated from the drive moment acting on the bobbin. During the acceleration phase of the pattern disruption, the following drive moment acts on the bobbin:

$$m_{Spule}=m_{Reib}-m_{Verlust}-m_{Belastung}.$$

This moment causes an rpm increase of the bobbin within a defined time interval. The following applies here:

$$m_{Spule}=\Phi_{Spule}\times J_{Spule}$$

During the run-out phase of the drum and bobbin, the friction moment $m_{Reib}=0$, and the bobbin rpm are reduced because of the loss and load moments acting on the system. Since in this phase the system is without any further external influences, these moments can be calculated by means of the courses of the angular speed. An uncoupling of the moment determination between the rotating bodies of bobbin and drum is performed by means of the calculation of the corresponding yields. Therefore the following applies to the loss and load yield detected in the run-out of the pattern disruption:

$$p_{Verlust,Belastung}=m_{v,B/Trommel}\times\omega_{Trommel}+m_{v,B/Spule}\times\omega_{Spule}$$

While there is no possibility of measuring the loss yield of the drum-bobbin system with the available measuring devices, the sum of the drive loss yield and the load yield as a result of the yarn tension force can be explicitly determined.

The determination of the frictional and convection losses of the drum drive can be performed with the aid of run-out curves. Since the winding speed, and therefore the angular speed of the drum during the winding operation, vary only by the set pattern disruption lift (for example between ±1.5% to ±6%), the determination of this loss yield is only meaningful in this operational range. For this reason a model statement can be selected which takes into consideration the run-out increase of the drum speed in the area of the production speed. Therefore the following applies:

$$m_{v/Trommel}=-J_{Trommel}\times(\Delta\omega_{Trommel}/\Delta t|_{Arbeitspunkt})$$

wherein $J_{Trommel}$ is the drum inertia.

The measurement of the increase of $\Delta\omega_{Trommel}/\Delta t$ can be performed during the normal production operation without a noticeable production loss. Following each winding process interruption, the drum drive needs to be uncoupled (lifting of the cheese) from the bobbin and switched off for only a short time. After the initial increase has been measured, the drum operation can be actively braked in order not to permit the creation of unnecessary production losses. Since this loss moment is constant during a bobbin winding operation, it is only necessary to perform the run-out measurements after each process-related interruption of the winding process.

The determination of the drive output is performed by means of the measured acceleration moments of the drum and bobbin. Taking into consideration the equation $$m_{v,B/Spule}=J_{Trommel}\times\Phi_{Trommel}\times(r_{Spule}/r_{Trommel})+(J_{Spule}\times\Phi_{Spule})$$

the result of the calculation of the total drive output during the acceleration-free phases therefore is:

$$p_{Antrieg}=m_{Trommel}\times\omega_{Trommel}+m_{Spule}\times\omega_{Spule}+p_{V,B}$$

If this output is related to the associated moment of the drum drive, the following applies: $m_{Antrieb/Spule}=p_{Antrieb}/\omega_{Trommel}$. The determination of the frictional moment generated by means of the frictional force is based on the equation for the total drive output. However, the yields listed in this equation are not all calculated by means of the friction. The pure drum drive output, the pure output for moving the drum, has no effect on the cheese. In the same way, the drive losses of the drum are without importance for the frictional moments. After converting the equation, the following results for the friction yield:

$$p_{Reib}=m_{Spule}\times\omega_{Spule}+p_{V,B}$$

In this case the frictional moment, related to the cheese, is calculated as follows:

$$m_{Reib/Spule}=p_{Friktion}/\omega_{Spule}$$

In the acceleration phase of the pattern disruption, the frictional slippage, taking into consideration the frictional parameters of the drum-bobbin system, generates the friction force and therefore the drive moment on the bobbin. A direct dependence from the bobbin-technological parameters, such as contact pressure compensation, type of yarn, bobbin mass, yarn preparation, etc. can be seen.

Figure 8:
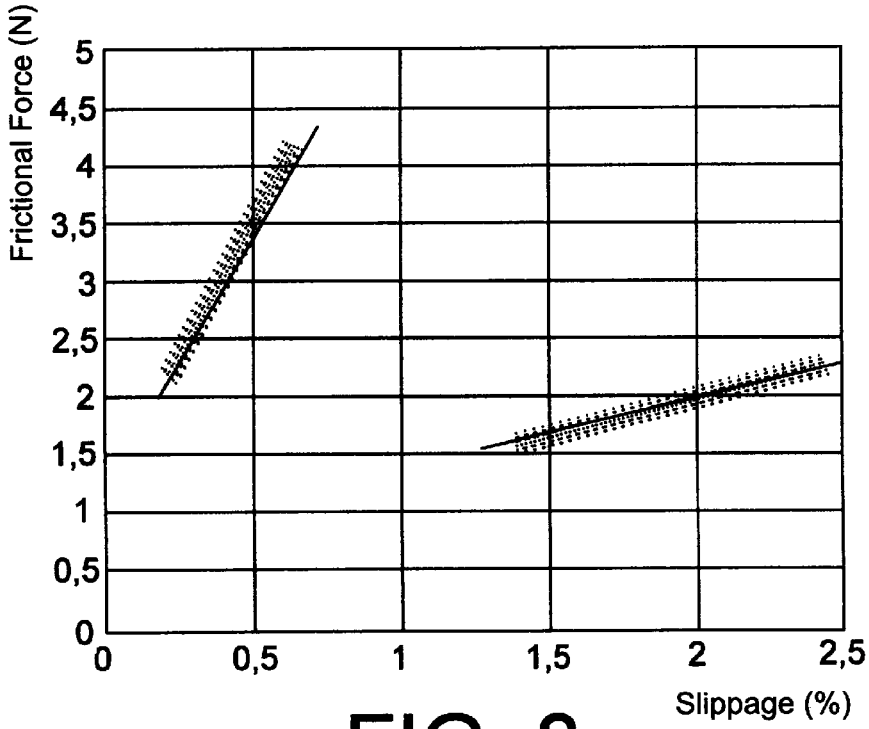
FIG. 8 is another graph showing the frictional force applied over the slippage, separately for a waxed and an unwaxed yarn.

If the operating points of the slippage measured during the bobbin winding operation and calculated by means of the equation $v_{Spule}(t)=(1-s(t))\times v_{Trommel}(t)$, or respectively the equation: $m_{Reib/Spule}=p_{Friktion}/\omega_{Spule}$ and the operation points of the friction force calculated by means of the equation of the frictional moment are drawn in a diagram $f_{Friktion}=f(s)$, a cluster of points results. The clusters of points of two bobbin winding operations have been entered in FIG. 8. Two conical bobbins were wound. All set parameters, except for the yarn preparation, were the same, i.e. the same yarn count, Nm 24, the same winding speed and the same pattern disruption of 6%. A medium contact pressure compensation was set. The clusters of points show a linear dependence between frictional force and slippage. This dependence can be approximated with the aid of a straight line. The behavior of a cluster of points during the winding process can be represented by means of the two parameters.

In order to be able to perform a more accurate localization of the characteristics of the cluster of points, and therefore of the process properties, it is possible to determine and process the center and scattering of the cluster of points by means of this representation. The effect of the paraffin application can be clearly seen in FIG. 8. Without having to perform a localization of the cluster of points, it is possible by means of the increase of the cluster of points in the slippage-frictional force diagram alone to detect the quality of the paraffin application. With the unwaxed yarn, the increase of the cluster of points is 4.2 N/%, that of the waxed yarn 0.63 N/%. The method in accordance with the invention for monitoring the paraffin application can be considered to be very dependable since the preparation of the yarn, i.e. the paraffin application, has a direct effect on the friction number $\mu$ of the friction drive.

If a yarn tensile strength sensor 13 is provided at the winding station, it can have a connection with the evaluation device 25, so that the changes in yarn tensile strength can be taken into account when determining the slippage. One of the most essential influence factors which have no relation to the coefficient of friction of the cheese, is thereby eliminated.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for monitoring the application of paraffin to a traveling yarn at a winding station of a cheese-producing textile machine, comprising the steps of driving a cheese frictionally by peripheral contact with a driven friction drum, alternatingly switching the driving of the friction drum on and off at intervals to produce periodic acceleration phases causing slippage between the friction drum and the cheese and intervening slippage-free run-out phases for preventing pattern yarn windings, and monitoring frictional behavior between the cheese and the friction drum during the yarn winding by determining and evaluating values which are proportional to the coefficient of friction including continuously determining and comparing the peripheral speeds of the friction drum and the cheese as winding of the cheese progresses and identifying significant deviations in the relationship of the peripheral speeds of the friction drum and the cheese as a loss of paraffin application.

2. The method in accordance with claim 1, and further comprising stopping the winding station when a loss of paraffin application has been determined.

3. The method in accordance with claim 2, and further comprising generating an operator signal indicating a loss of paraffin application has been determined.

4. The method in accordance with claim 1, and further comprising determining and evaluating the slippage between the cheese and the friction drum as a value which is proportional to the coefficient of friction.

5. The method in accordance with claim 4, and further comprising determining the frictional force of the friction drum on the cheese by determining a drive moment transmitted by the friction drum to the cheese as a function of the slippage.

6. The method in accordance with claim 5, wherein the determining the frictional force comprises measuring loss and load moments acting on the friction drum and the cheese during the slippage-free run-out phase.

7. The method in accordance with claim 4, and further comprising measuring the yarn tensile strength during the cheese winding, and the adjusting the slippage value according to changes in the yarn tensile strength.

8. The method in accordance with claim 4, and further comprising determining a yarn deposit shift by displacing a yarn traversal reversing point on a circumferential line on the cheese in respect to a preceding yarn traversal reversing point as a function of the slippage value and evaluating the frictional behavior of the cheese on the friction drum in relation to the yarn deposit shift.

9. The method in accordance with claim 1, and further comprising averaging frictional values of the cheeses on the friction drums of a plurality of winding stations of the bobbin winding machine and comparing the frictional behavior at each individual winding station in relation to said averaging.

* * * * *